US009638411B2

(12) United States Patent
Saltalamacchia

(10) Patent No.: US 9,638,411 B2
(45) Date of Patent: May 2, 2017

(54) APPARATUS AND METHODS FOR ILLUMINATING AN AREA SURROUNDING A BRUSH

(76) Inventor: Emanuele Antonio Saltalamacchia, Garfield, NJ (US)

( * ) Notice: Subject to any disclaimer, the term of this patent is extended or adjusted under 35 U.S.C. 154(b) by 888 days.

(21) Appl. No.: 13/473,425

(22) Filed: May 16, 2012

(65) Prior Publication Data

US 2012/0294470 A1 Nov. 22, 2012

Related U.S. Application Data

(60) Provisional application No. 61/486,432, filed on May 16, 2011.

(51) Int. Cl.

| | |
|---|---|
| ***H04R 1/02*** | (2006.01) |
| ***F21V 33/00*** | (2006.01) |
| ***A46B 5/02*** | (2006.01) |
| ***A46B 15/00*** | (2006.01) |

(Continued)

(52) U.S. Cl.

CPC ..... *F21V 33/0084* (2013.01); *A46B 5/02* (2013.01); *A46B 15/0036* (2013.01); *B25G 1/02* (2013.01); *F21V 33/0056* (2013.01); *A46B 2200/202* (2013.01); *F21Y 2101/00* (2013.01); *H04R 1/028* (2013.01)

(58) Field of Classification Search

CPC ..... A46B 5/02; A46B 15/0002; A46B 15/004; A46B 15/0028; A46B 15/0036; A46B 15/0038; A46B 15/0042; A46B 15/0044; A46B 17/02; A46B 2200/202; B25G 3/10; B25G 1/102; B25G 1/02; B25G 3/32; F21V 33/0056; F21V 33/0084

USPC ..... 381/334

See application file for complete search history.

(56) References Cited

U.S. PATENT DOCUMENTS

| | | | | |
|---|---|---|---|---|
| 4,916,773 | A * | 4/1990 | McCoy | 15/205.2 |
| 6,138,313 | A * | 10/2000 | Barton et al. | 15/143.1 |
| 6,154,912 | A * | 12/2000 | Li | 15/105 |

(Continued)

FOREIGN PATENT DOCUMENTS

WO WO 2011/054108 5/2011

OTHER PUBLICATIONS

Durometer Made Easy, Durometer Hardness Scales—General Reference Guide, Paramount Industries, 2008.*

(Continued)

*Primary Examiner* — Duc Nguyen
*Assistant Examiner* — Kile Blair

(57) ABSTRACT

The present invention is a multifunctional electronic light emitting removable grip sleeve for a paintbrush. A paintbrush is to be inserted into an encasement to improve handling and control over the paintbrush. The encasement is ergonomic and smoothly contours to the hand of a painter or user. Within the encasement are two elastic walls that can be tapered to allow the handle of a paintbrush to become lodged as it is inserted. Atop the encasement is a plurality of illuminating sources, preferably LED's, which are used to direct light onto a painted surface. Additionally, a multitude of electronic components can be installed into the present invention in increase productivity and provide convenience for the painter. For example, Bluetooth technology can be implemented into the encasement, similar to cellular phones, along with a radio scanner, a stereo system, and a USB port. Painting is facilitated by using the present invention.

21 Claims, 16 Drawing Sheets

(51) Int. Cl.
*B25G 1/02* (2006.01)
*F21Y 101/00* (2016.01)

(56) References Cited

U.S. PATENT DOCUMENTS

| | | | | |
|---|---|---|---|---|
| 7,127,770 | B2 | 10/2006 | Clegg | |
| D562,010 | S * | 2/2008 | Goulet et al. | D4/199 |
| D572,907 | S | 7/2008 | Byrne | |
| 2005/0204500 | A1* | 9/2005 | Mikula | 15/207.2 |
| 2006/0215391 | A1 | 9/2006 | Jones | |
| 2008/0060154 | A1* | 3/2008 | Jansheski | 15/105 |
| 2008/0263829 | A1* | 10/2008 | Diasio | 16/421 |
| 2012/0054986 | A1 | 3/2012 | Wood | |
| 2012/0227197 | A1* | 9/2012 | Fleischer | A46B 7/04 15/105 |

OTHER PUBLICATIONS

James Byrne, The Wooster Brush Company, <http://www.coroflot.com/jmbyrne/The-Wooster-Brush-Company>, Oct. 14, 2009.*

* cited by examiner

APPARATUS AND METHODS FOR ILLUMINATING AN AREA SURROUNDING A BRUSH

The current application claims a priority to the U.S. Provisional Patent application Ser. No. 61/486,432 filed on May 16, 2011.

FIELD OF THE INVENTION

The present invention relates generally to a painting accessory. More particularly, its objective is to provide a paintbrush with an ergonomic grip sleeve surrounding the paintbrush handle and is capable of emitting light upon the painted surface.

BACKGROUND OF THE INVENTION

Paintbrushes are typically manufactured to a set standard. These paintbrushes have a plurality of bristles, a wide paintbrush head and an elongated thin handle in which the bristles are fitted onto the paintbrush head and the paintbrush head is connected to the elongated thin handle. The majority of the weight is distributed near the wide paintbrush head. Oftentimes, this requires a painter to apply a tight grip onto the thin paintbrush handle to hold and operate it, which can become very strenuous over time. This tight grip must constantly be applied onto the handle in order to achieve the best handling over the paintbrush. For recreational painters that may have physical disabilities, particularly with the hand, painting can be near impossible with standard paintbrushes because they are neither ergonomic, nor do they easily grip into the hand of the painter. Gripping and handling these paintbrushes depends upon the painter's physical abilities—how much force can be applied from the hand onto the handle and how much strain the hand can tolerate.

Another aspect of painting that is often overlooked is proper lighting on a painting surface. The intensity of light on the surface, the angle the light is directed onto the surface and even the amount of heat that irradiates from the lighting source are all factors leading to a painted surface that is either streak-free and or degraded with blemishes and blotches. A degraded painted surface requires multiple coats of paint to be applied until paint streaks and blotches become no longer noticeable. This is typically a result of the painted surface being poorly lit during the process of painting. In a poorly lit environment, a painted surface may appear streak-free and without blotches; however, such blotches and paint streaks may become increasingly noticeable as the intensity of light upon the surface is increased. If the light is inaccurately directed onto the surface while painting, such blotches and streaks will remain unseen to the painter. Usually floor lights or construction lights and lamps are used to light the painted surface. These can disperse significant amounts of heat into the environment, upon the painted surface and upon the painter. Further from this being an inconvenience, the immense heating can sometimes be detrimental because the wet paint dries before it has been properly distributed across the painted surface. A painter must first recognize that the heat is drying the paint too quickly and then distribute the paint faster. Consequently, if not, the paint may need to be stripped or reapplied.

Poor lighting that leads to poor paint jobs are especially apparent when painting with a paintbrush because the body of the painter can cast a shadow on a surface being painted that is much larger than the paintbrush; ultimately, this defeats the purpose of the lighting. Since most rooms are rectangular, the lighting must be repositioned as each wall is painted because of the shadows being cast from the painter and the adjacent walls. Newer homes or buildings that are to be painted sometimes do not have a power source for the construction lamps and lights to operate. This dilemma forces a painter to use natural lighting within the room or to draw power from a portable generator. Natural light cannot be directed to any location at any instant and portable generators are usually heavy and a nuisance to transport.

Paintbrushes are most commonly used when detailing along lines or contours, as well as edges between two painted surfaces because a painter can more finely control the motion of the paintbrush and the area that is being painted. It can be difficult to paint along the medium between different painted surfaces or dissimilar colors and their respective contours. Therefore, handling and control over the paintbrush is strictly important.

With advancements in technology, electronics are being installed in devices that were once considered too small to withhold them, causing the devices to become bulky. The power requirements may have required large batteries or the electronics processors that actually control the electronics may have been too large to fit into such devices. Nowadays, these electronics processors are capable of operating a multitude of electronics while also being minimal in size. A painter, along with many other labor oriented professions, use a variety of electronics while working such as the lighting system that must be positioned correctly, a stereo to listen to that increases productivity or cellular phones to communicate with others, as examples. Although these electronics have many positive functions and provide much convenience to a painter, operating these electronics while working is difficult because each device must be operated individually. Constant moving from room to room and painting surface to painting surface increases the likelihood of these electronics to need to be relocated and possible reconnected to their respective power sources. Even if the electronics are portable, all would need to be carried by the painter since a painter is moving around often. An all inclusive single device that comprises these electronics would be convenient and also increase the speed and productivity of the painter.

The object of the present invention is to: provide lighting to a surface being painted more effectively; to provide a painter with better handling and control over the paintbrush; and to supply a painter with a single multifunctional electronic device that facilitates painting. The described problems and inconveniences with painting and all claimed objectives of the present invention are solved and achieved with a multifunctional electronic light emitting removable grip sleeve for a paintbrush.

DESCRIPTION OF PRIOR ART

International Patent Publication No. 2011/054108 A10, filed Nov. 9, 2010, is a light pack for a paintbrush and includes a paint can lid attachment for a paintbrush to be held. The paintbrush described in this prior art can either be constructed as a single device in which lights are positioned around the brush head near the bristles, as an apparatus with the bristles being removable or as multiple attachments that can be configured to a standard paintbrush. The paint can lid attachment clamps to a paint can and serves as a holder for a paintbrush and provides lighting. The present invention is dissimilar to this prior art because it is not a sleeve cover for a paintbrush handle, nor is it ergonomic. This prior art can be attached to an existing paintbrush; however, this requires an assembly of an assortment of attachments. Furthermore, this prior art only describes a light pack for a paintbrush and it is not capable of integrating multiple electronic components that the present invention can comprise.

U.S. Patent Publication No. 2006/0215391 A1, filed Sep. 28, 2006, is a lighted detail brush. This lighted brush in this prior art depicts a lighting system used with a variety handheld cleaning implements. These cleaning implements can direct light into a specified location, preferably to illuminate difficult to view areas. This prior art operates using a low power bulb or LED. The present invention is dissimilar to this prior art because the described lights are for use with cleaning equipment and do not relate to painting. Additionally, these lights are only integrated into the cleaning equipment and a grip sleeve is not provided for their handles.

U.S. Pat. No. 7,127,770 B2, issued Oct. 31, 2006, is an LED brush. The LED brush described in this prior art relates generally to cosmetic applications. The light from the LED's illuminate from a transparent handle to direct light from the end and from the sides of the transparent handle. Power is supplied to the LED's from a battery housed within the handle. The present invention is dissimilar to this prior art because the LED lights are not positioned to direct light from the translucent handle towards the bristles. This prior art relates to cosmetics and would not be compatible with a paintbrush. Also, this prior art is a single device and is not used as a grip sleeve.

U.S. Patent Publication No. 2012/0054986 A1, filed Mar. 8, 2012, is a paintbrush cover. The paintbrush cover depicted in this prior relates more particularly to a widened grip cover for a paintbrush. This prior art comprises a single opening for the entry of the paint brush handle and an inner cavity. The inner cavity can be tapered to provide an interference fit with the handle and the cover. The present invention is dissimilar to this prior art because the described cover only comprises a single entry region for the paintbrush handle to be entered. A paintbrush must be removed from the cover by grasping the head of the paintbrush and cannot be pushed out from the bottom of the handle. This prior art is not for use with electronics and does not provide any lighting to a painted surface.

DETAIL DESCRIPTIONS OF THE INVENTION

Figure 1:
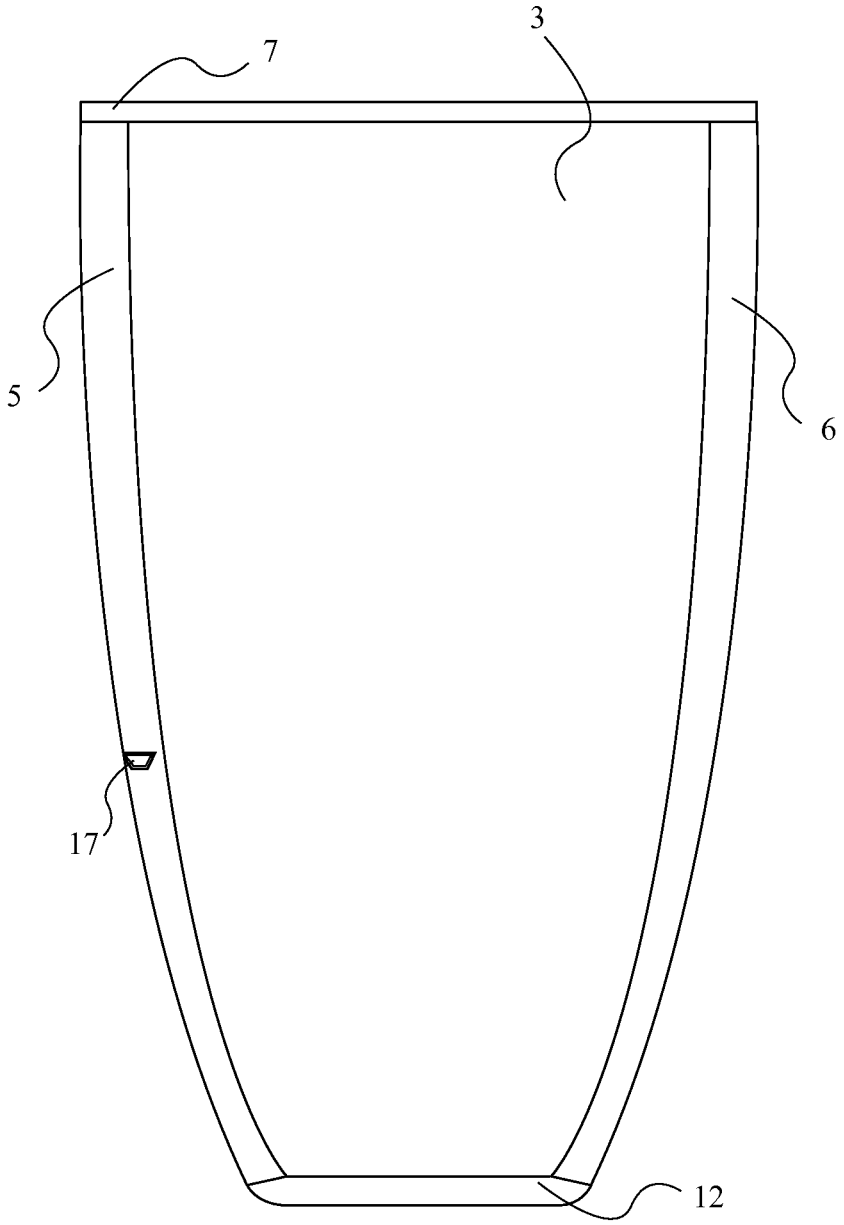
FIG. 1 is a front view of the present invention.

All illustrations of the drawings are for the purpose of describing selected versions of the present invention and are not intended to limit the scope of the present invention.

The present invention is a multifunctional electronic light emitting removable grip sleeve for a paintbrush, which is shown in FIG. 1-FIG. 15. The present invention provides a user, typically a painter, with a specialized holster that grips to the handle of a paintbrush; has the ability to direct light, enhancing vision onto a painted surface; and can operate a multitude of electronics within a single device. The present invention primarily comprises an encasement 1 and a plurality of illuminating sources 14. The encasement 1 is used to: enclose a portion of a paintbrush handle to provide a painter with an ergonomic grip, reducing strain on the hand; provide the painter with increased handling over the paintbrush, which is especially useful when painting near the edge of conjoining surfaces or when painting difficult or intricate designs; and also encloses any electronics being operated which includes the illuminating sources 14. The illuminating sources 14 provide lighting onto a painted surface by directly projecting the light from the head of the paintbrush. As a result, the painted surface becomes visually enhanced, allowing the painter to more easily discern whether or not there are blemishes on the surface. Since the illuminating sources 14 move with the paintbrush, the painter is less likely to need to apply additional coats to the painted surface. Fewer coats would be needed because the painter would notice these blemishes while painting and be able to correct them as the current coat is being applied.

As is shown in FIG. 1-FIG. 7, the encasement 1 comprises a wide top surface 7, a narrow bottom surface 12, a wave-shaped wall surface 2, a flat wall surface 3, a round left edge 5, a round right edge 6, an open passage, a universal serial bus (USB) port 17, a light switch 18, a thumb groove 4, a left elastic wall 10 and a right elastic wall 11. The wide top surface 7 further comprises a first receiving aperture 9 and a plurality of recessed grooves 8, and the narrow bottom surface 12 further comprises a second receiving aperture 13. The wave-shaped wall surface 2 is positioned oppositely to the flat wall surface 3 in which the round left edge 5 and the round right edge 6 conjoin these surfaces—the round left 5 edge is positioned oppositely to the round right edge 6. The encasement 1 can also comprises a thumb groove 4 that is positioned atop the flat wall surface 3. The preferred embodiment of the thumb groove 4 is an angled recessed section of the flat wall surface 3 that is capable of having a thumb being snuggly fit within. The thumb groove 4 is essentially a smooth recessed groove in the flat wall surface 3 that is located at a position which the average painters thumb would be, in accordance with the ergonomic shape of the wave-shaped wall surface 2. The wave-shaped wall surface 2, flat wall surface 3, round left edge 5 and the round right edge 6 are enclosed by the wide top surface 7 and the narrow bottom surface 12—the wide top surface 7 is positioned oppositely to the narrow bottom surface 12. The wide top surface 7 is also concentrically positioned above the narrow bottom surface 12, slightly resembling a cone. The unique shape of the encasement 1 allows the encasement 1 to be ergonomic.

Figure 2:
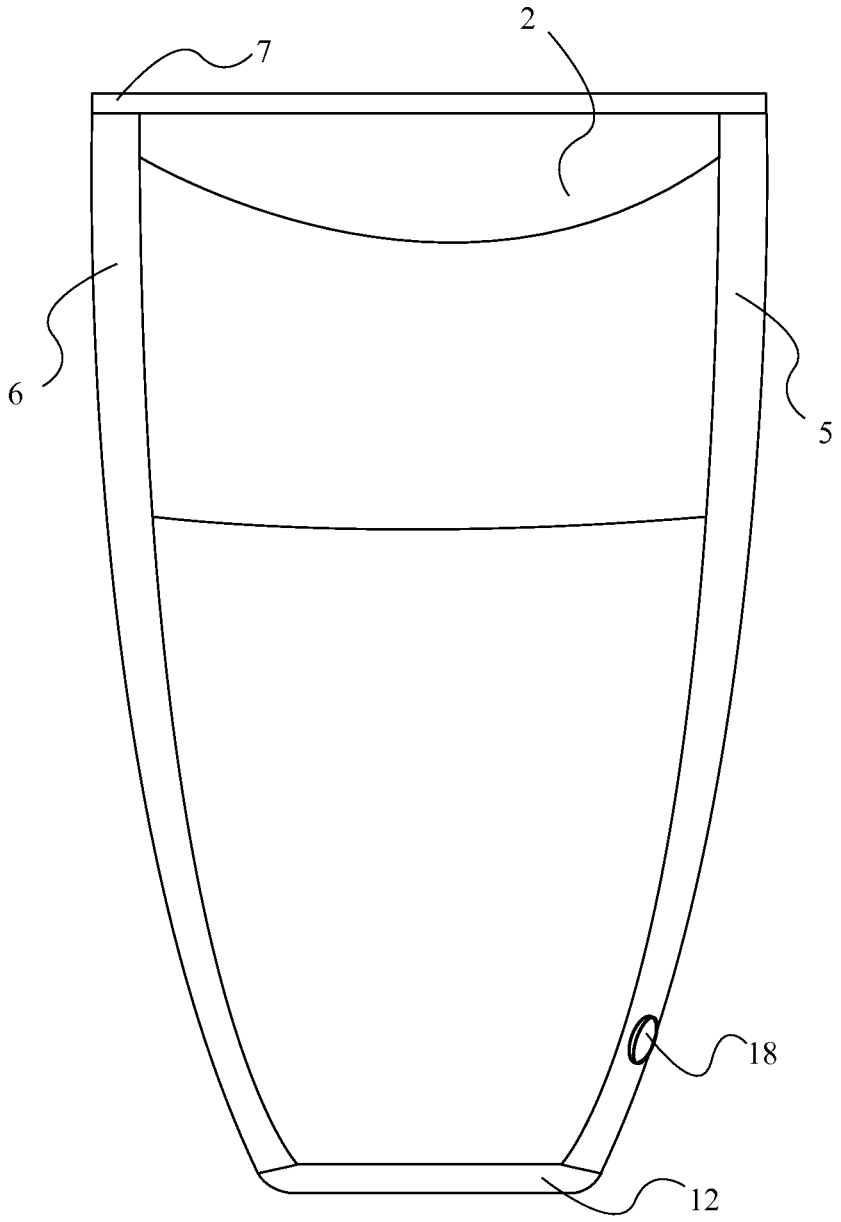
FIG. 2 is a rear view of the present invention.
Figure 5:
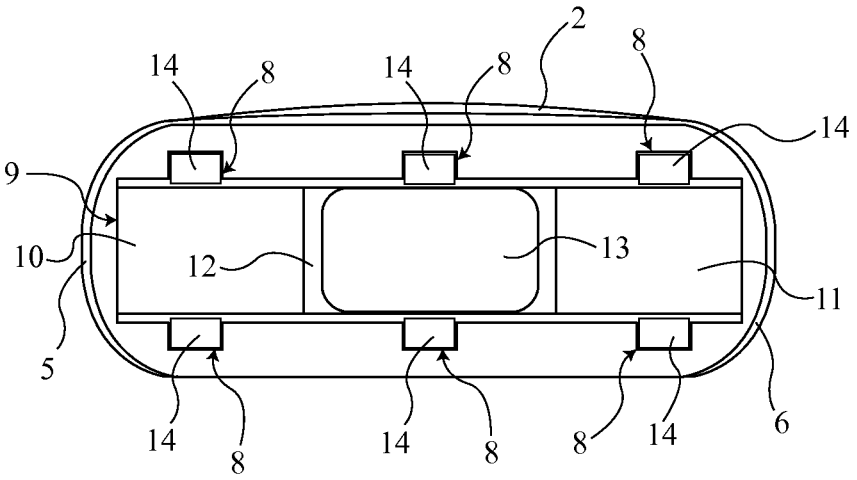
FIG. 5 is a top view of the present invention.
Figure 6:
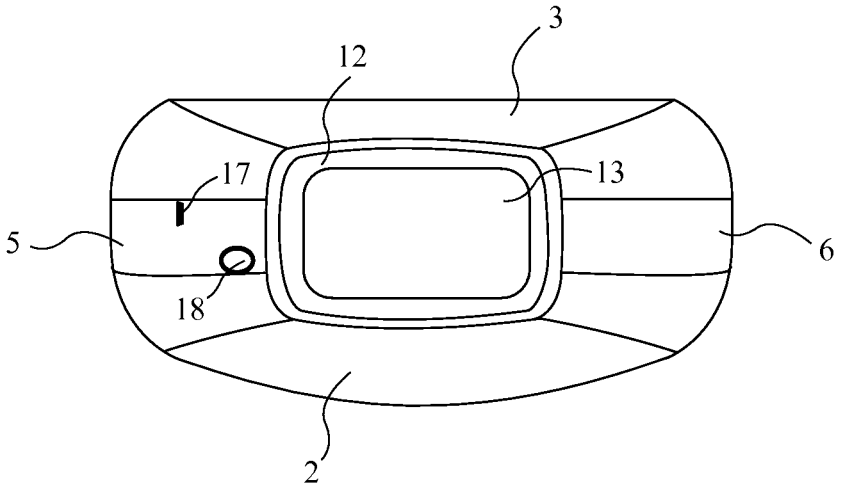
FIG. 6 is a bottom view of the present invention.
Figure 7:
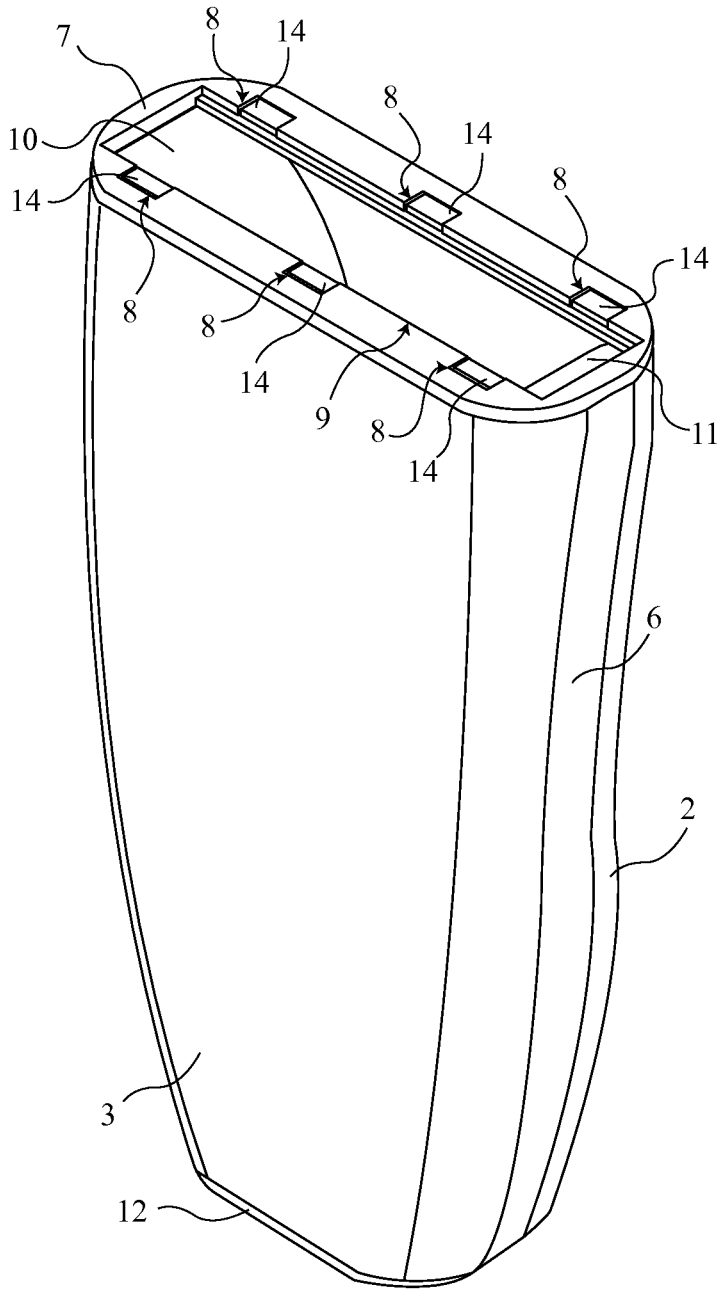
FIG. 7 is a perspective view of the present invention.
Figure 8:
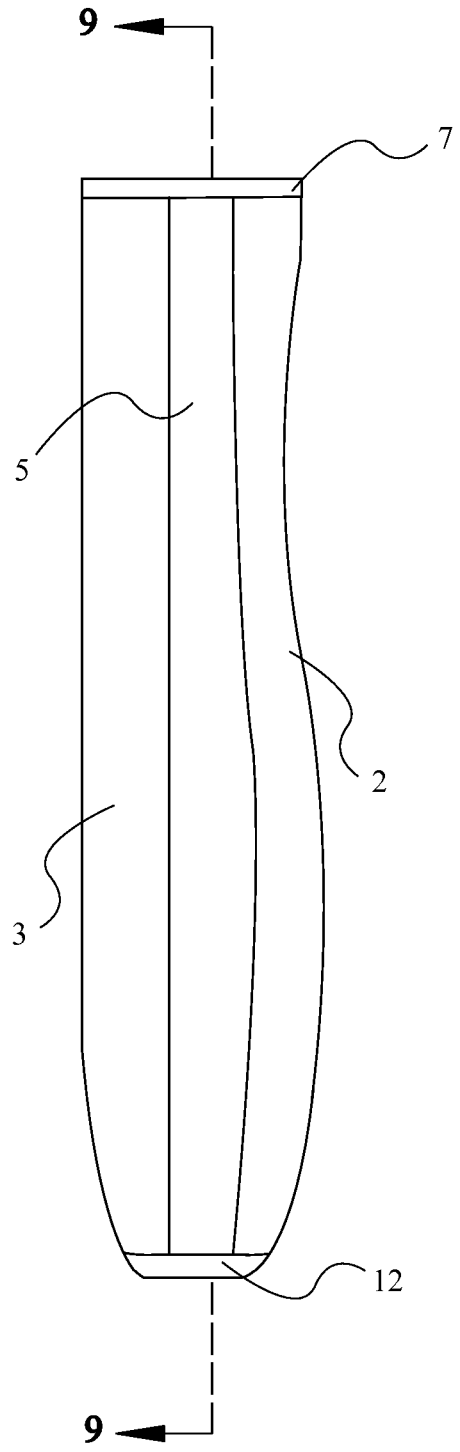
FIG. 8 is a side view of the present invention, showing the plane 9-9 that a cross section is made.

The ergonomic nature of the present invention decreases the amount of strain induced into a painters hand while holding the encasement 1 with a paintbrush attached. This is enabled by the contrasting wall surfaces and the gradual increasing width of these wall surfaces. The increasing width of the wave-shaped wall surface 2 is shown in FIG. 1 and the increasing width of the flat wall is shown in FIG. 2. As is shown in FIG. 5, the preferred shape of the wave-shaped wall surface 2 is such that it bows outward from the narrow bottom surface 12, towards the wide top surface 7, and then bows inward as it connects to the wide top surface 7. Furthermore, the preferred shape of the flat wall surface 3 should remain smooth and flat with minimal or no curvature. Positioned on the flat wall surface 3 about midway between the wide top surface 7 and the narrow bottom surface 12 should be a thumb groove 4. The duality of the shape of the wave-shaped wall surface 2 and the thumb groove 4 of the flat wall surface 3 achieves the claimed ergonomic nature of the lateral ergonomic wall and the painter's ability to more easily handle the paintbrush when it is attached within the encasement 1. By utilizing contrasting wall surfaces, the encasement 1 should also more easily fit within the hand of a painter. Typically, the wave shape contours to the palm of a hand with the four main digits, excluding the thumb. The thumb should enwrap around either the round left edge 5 or the round right edge 6, depending on the dominant or painting hand of the painter, and fit within the thumb groove 4 on the flat wall surface 3. Also it should be noted that the USB port 17 and the light switch 18 should be positioned on the ergonomic wall in a location that does not depart from the ergonomic nature of the encasement 1. A rubber binding or similar existing or future technology can enwrap the encasement 1 to further enhance its gripping capability.

Figure 9:
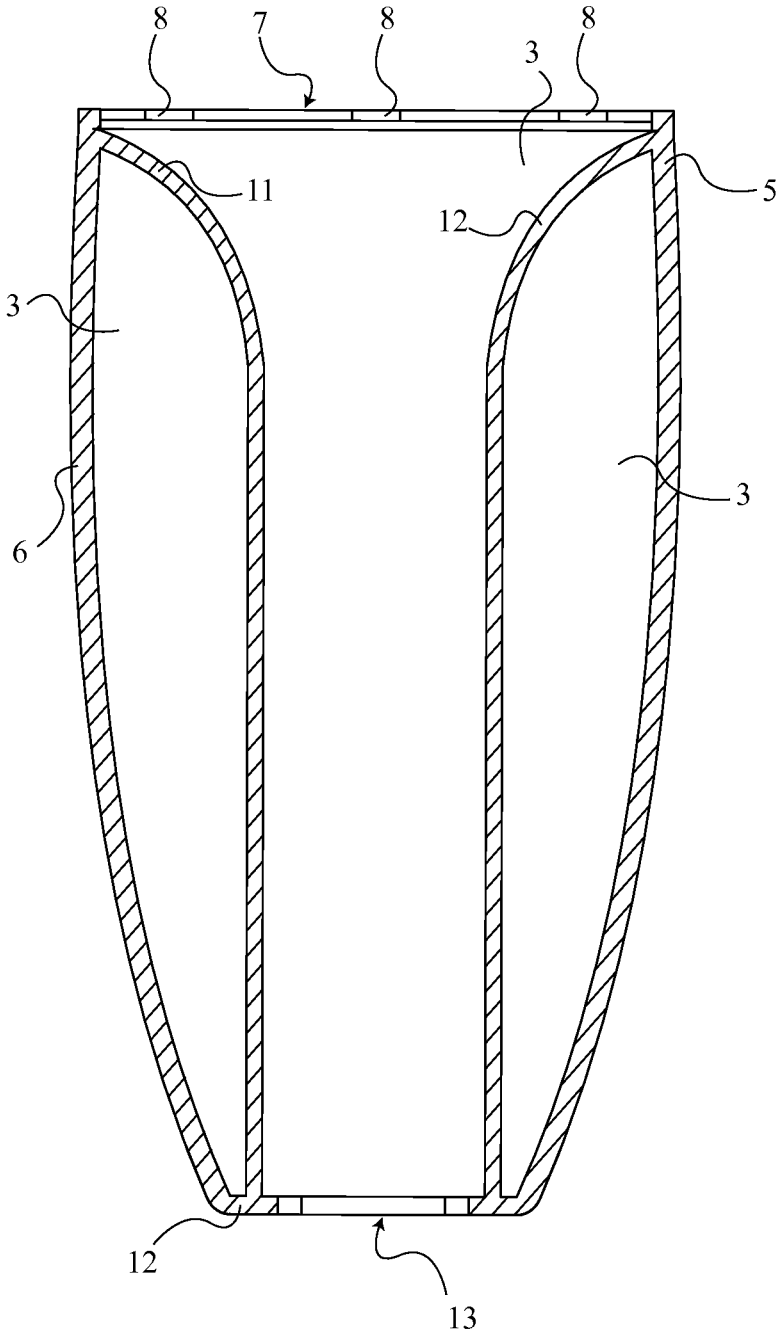
FIG. 9 is a front cross sectional view taken along the plane 9-9.
Figure 10:
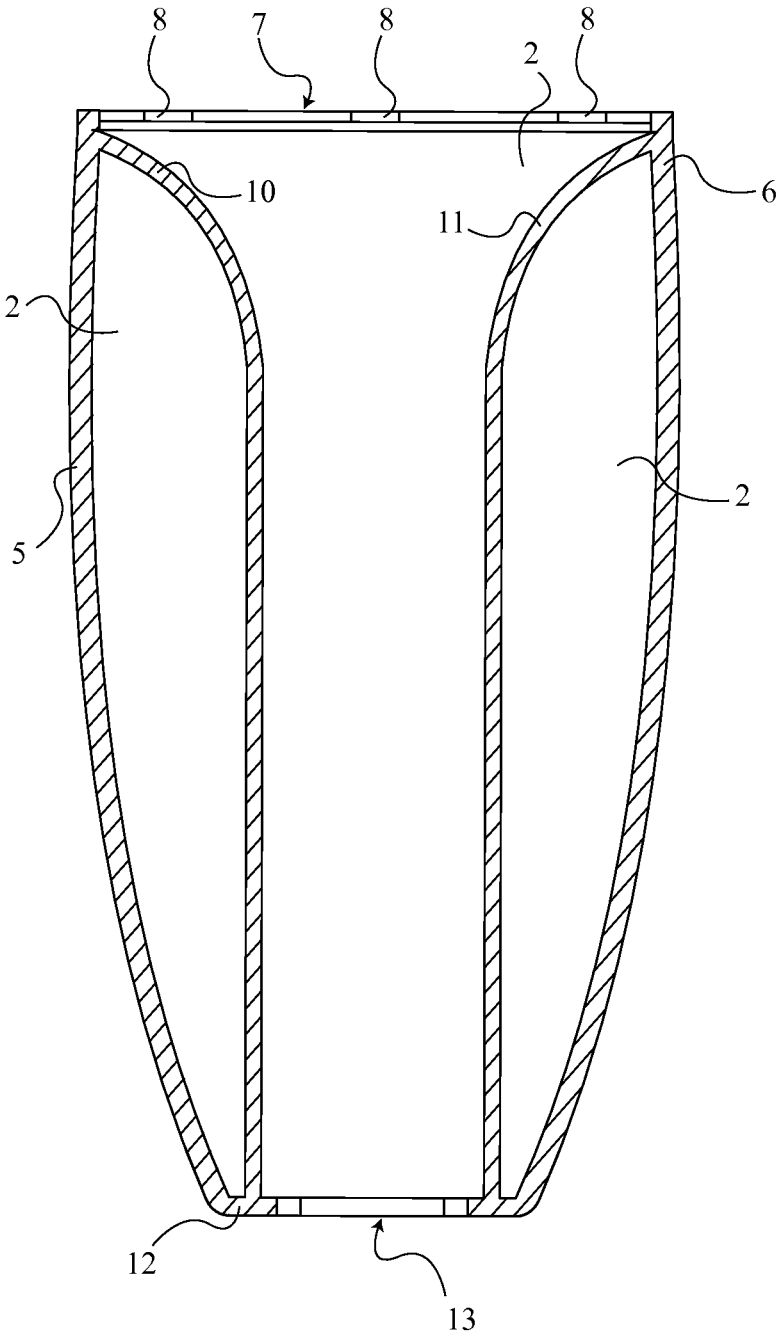
FIG. 10 is a rear cross sectional view taken along the plane 9-9.

In order for a paintbrush to be inserted within the encasement 1, apertures on the wide top surface 7 and the narrow bottom surface 12 are provided. The first receiving aperture 9 is concentrically positioned on the wide top surface 7. The second receiving aperture 13 is concentrically positioned on the narrow bottom surface 12. The wide top surface 7 is positioned oppositely to the narrow bottom surface 12, wherein the ergonomic wall surfaces serve as the medium between both the wide top surface 7 and the narrow bottom surface 12. An open path from the first receiving aperture 9 to the second receiving aperture 13 should be made within the encasement 1, which is denoted by the open passage. Contained within the encasement 1 are the left elastic wall 10 and the right elastic wall 11. As is shown in FIG. 9 and FIG. 10, the left elastic wall 10 is connected to both the wave-shaped wall surface 2 and the flat wall surface 3; concurrently, the right elastic wall 11 is connected to both the wave-shaped wall surface 2 and the flat wall surface 3, but oppositely to the left elastic wall 10. These elastic walls should be tapered such they follow the decreasing trend of the encasement 1, from the wide top surface 7 to the narrow bottom surface 12. Therefore, the open passage should have a greater volume near the wide top surface 7 than near the narrow bottom surface 12. The open passage is delineated by the first receiving aperture 9, the second receiving aperture 13, the left elastic wall 10, the right elastic wall 11, the round left edge 5, the round right edge 6, the flat wall surface 3 and the wave-shaped wall surface 2.

Figure 12:
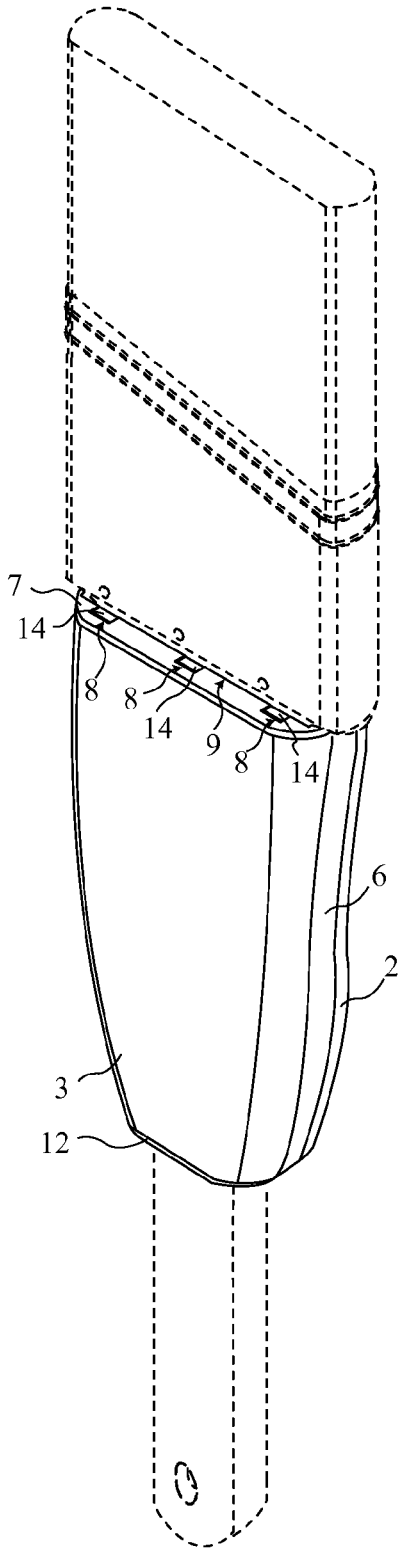
FIG. 12 is a perspective view of the present invention, showing a paintbrush lodged within the encasement.
Figure 13:
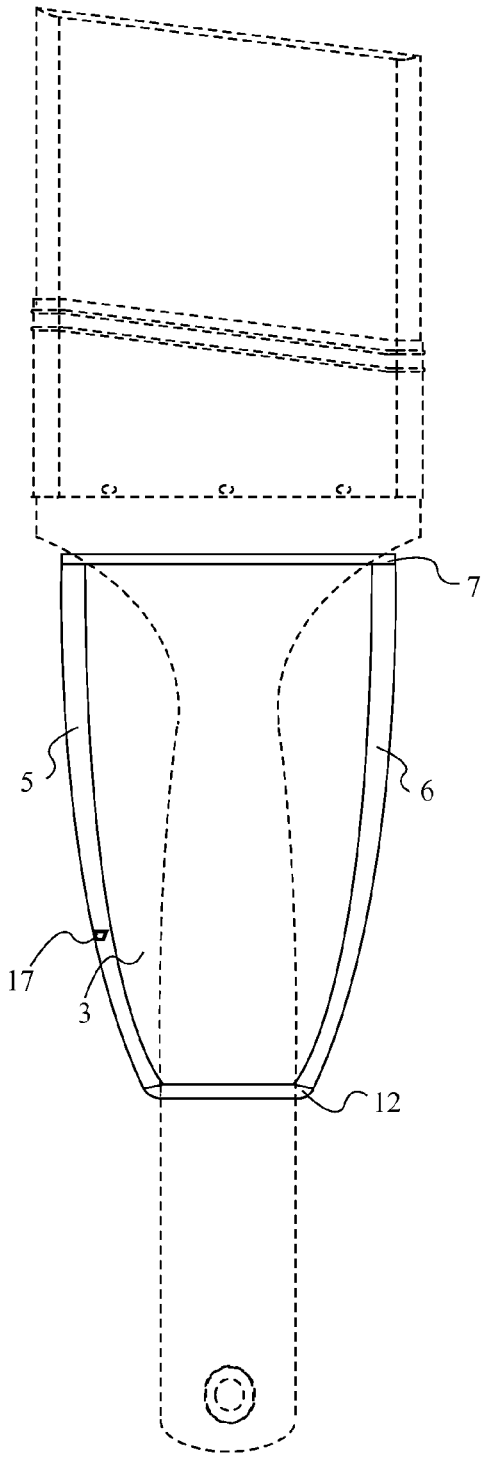
FIG. 13 is a front view of the present invention, showing a paintbrush lodged within the encasement.

The design of the encasement 1 facilitates being used as a grip for a paintbrush. To be used as a grip, the bottom handle of a paintbrush should be first inserted through the first receiving aperture 9. As the handle is being traversed through the first receiving aperture 9 into the encasement 1, the handle of the paintbrush should make contact with both the left elastic wall 10 and the right elastic wall 11. A compressive pressure force should then be induced onto the handle from the left elastic wall 10 and the right elastic wall 11; the further the handle traverses through the encasement 1, the greater the compressive pressure force should become. This compressive pressure force onto the handle should cause the handle to become temporarily lodged within the encasement 1; FIG. 12 and FIG. 13 show a paintbrush lodged within the encasement 1. Since these inner walls are elastic, they should deform and ultimately contour and embody the portion of the paintbrush handle that has made contact with them. This ensures the painter that the paintbrush will not be too loosely fit within the encasement 1 and that handling over the paintbrush is not sacrificed. To dislodge the handle from the encasement 1, the painter should only need to pull on the head of the paintbrush or push the bottom handle through the encasement 1, through the second receiving aperture 13. If the paintbrush head has wet paint residue, it is usually undesirable to remove the paintbrush by pulling on the head because the wet paint residue can be messy and even can be damaging. Therefore, by pushing the paintbrush out of the encasement 1 from the second receiving aperture 13, the painter can safely and cleanly dislodge the paintbrush without ever making contact with the paintbrush head. Also, the embodiment of the encasement 1 should only house the handle of a paintbrush, further preventing any paint residue from leaking within the encasement 1.

The present invention directs light onto a surface using the plurality of illuminating sources 14. Atop the wide top surface 7 should be the plurality of recessed grooves 8 which the illuminating sources 14 are to be fitted within. These recessed grooves 8 should also be perimetrically positioned around the first receiving aperture 9. Each of the plurality of illuminating sources 14 are positioned and affixed within each of the plurality of recessed grooves 8 as is shown in FIG. 5. The preferred embodiment of each of the illuminating sources 14 is a light emitting diode (LED). LED's require less power to operate in comparison to construction floor lamps that painters commonly use to illuminate a painted surface. These LED's also emit significantly less heat. Since the illuminating sources 14 are fitted within the recessed grooves 8, they become protected from paint drips and paint residue that may leak from the bristles of the paintbrush while painting or while drawing paint out of a paint can. Since the illuminating sources 14 are positioned around the first receiving aperture 9, a painter can direct light using the illuminating sources 14 with the motion of a paintbrush that is fitted within the encasement 1. The illuminating sources 14 are further protected by attaching a light cover 20 overtop the wide top surface 7. The light cover 20 is essentially a translucent protective surface that encloses the illuminating sources 14 within each of the recessed grooves 8. Since paint may still leak from the bristles towards the encasement 1, the light cover 20 provides supplemental protection to the illuminating sources 14 without blocking their light.

Figure 3:
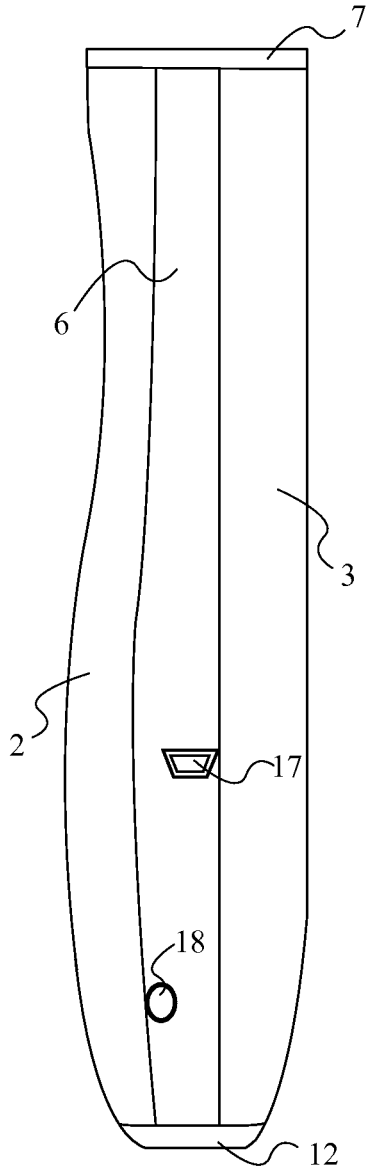
FIG. 3 is a left view of the present invention.
Figure 4:
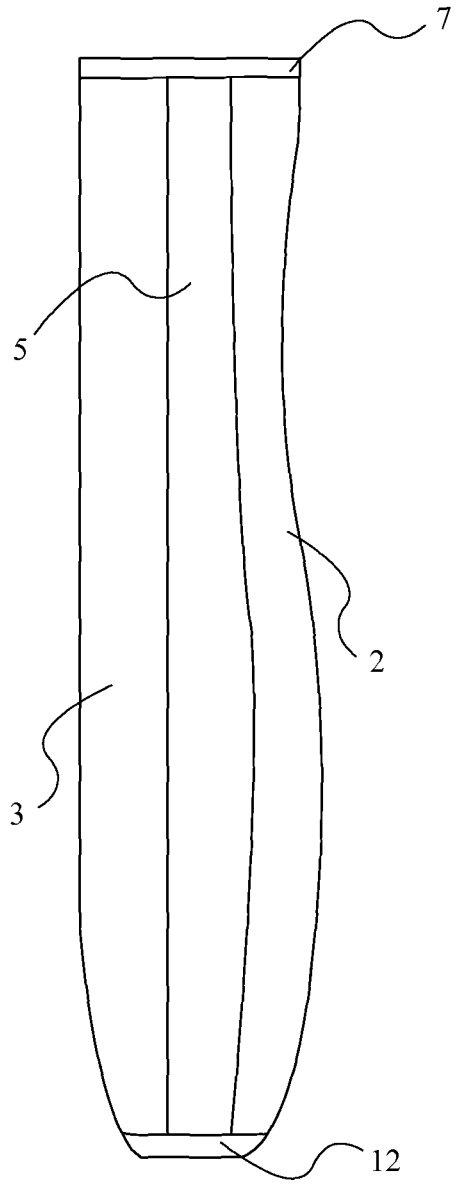
FIG. 4 is a right view of the present invention.
Figure 11:
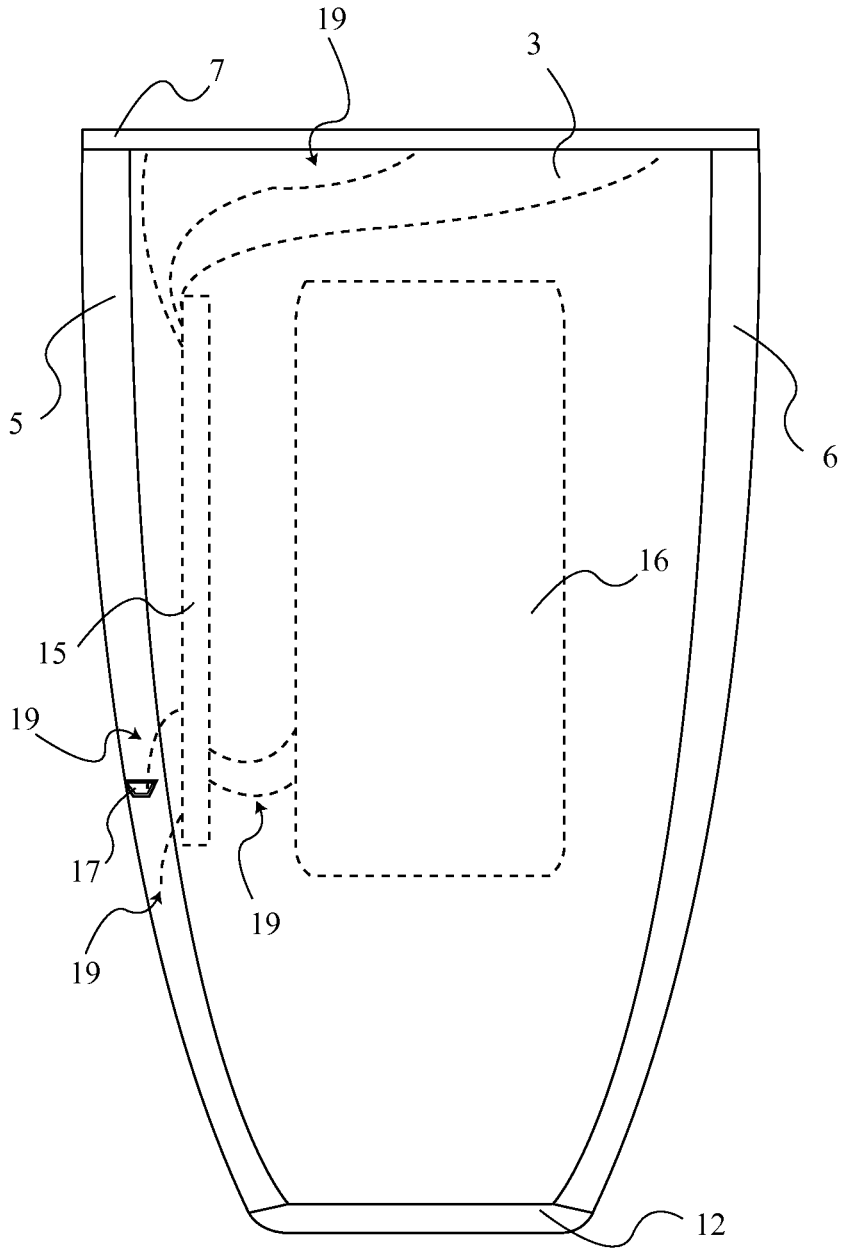
FIG. 11 is a front view of the present invention, showing the electrical components in dashed lines.
Figure 15:
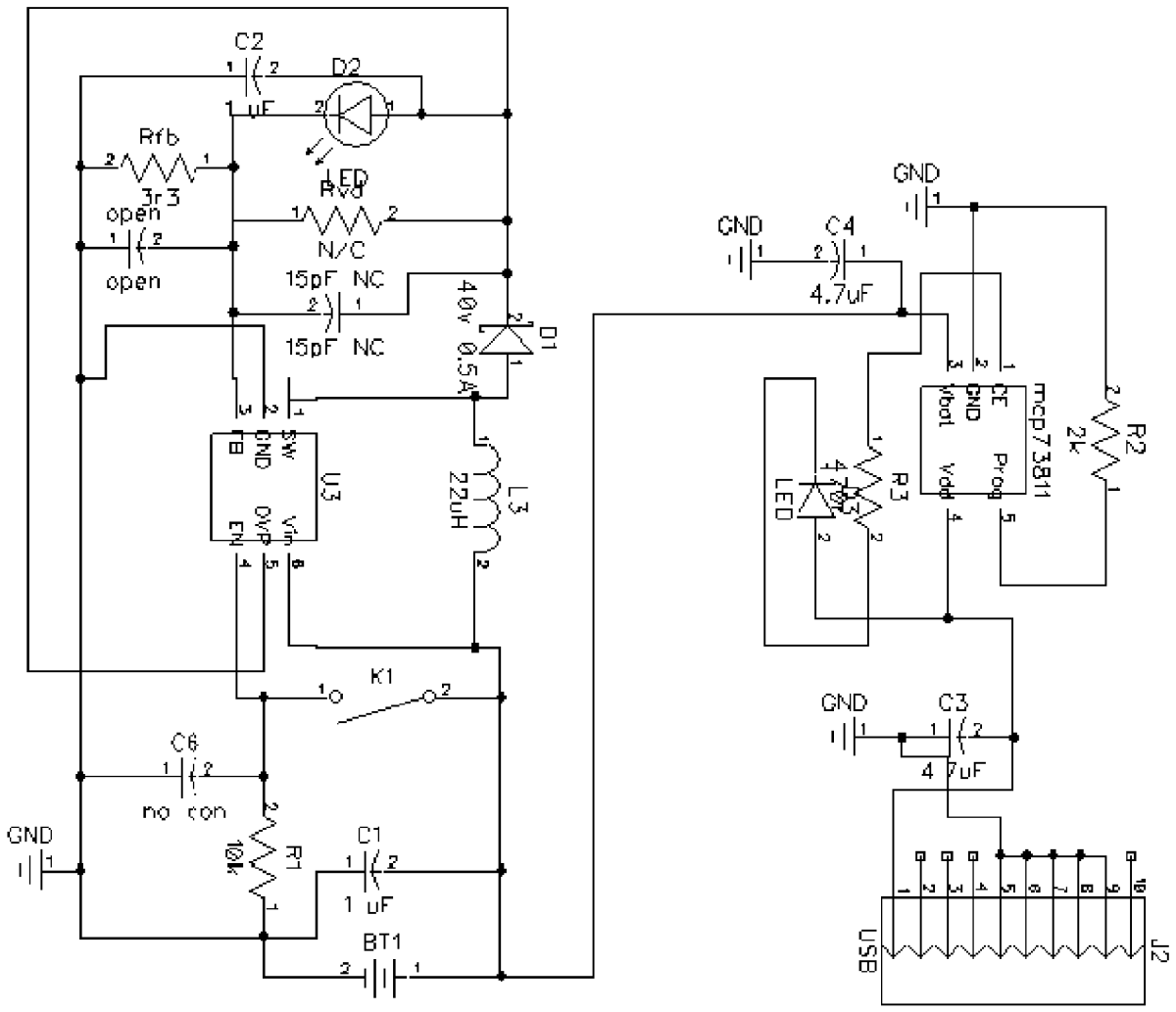
FIG. 15 shows the preferred embodiment of the electronics processor.

The present invention is an electrical device. To this end, the present invention comprises a power source 16, an electronics processor 15 and a plurality of wires 19. FIG. 11 shows the electrical components and connections within the encasement 1. All electronic components should be electrically connected to the electronics processor 15, preferably through the plurality of wires 19. The electronics processor 15 should have the ability to control any electrical and electronic installed into the present invention. The USB port 17, the light switch 18 and each of the plurality of illuminating sources 14 should be electrically connected to the electronics processor 15. The preferred embodiment of the electronics processor 15 is shown in FIG. 15. The preferred embodiment of the USB port 17 is a micro USB, which is shown in FIG. 3. This shows the preferred circuitry to control LED's and to receive power through the USB port 17 or the power source 16. The electronic components should receive power from the power source 16 by electrically connecting the electronics processor 15 to the power source 16 through a plurality of wires 19. The electronics processor 15 should be able to distribute power from the power source 16 to each electrically connected component. In the preferred embodiment of the power source 16, it is a battery. If the battery is rechargeable the battery should have the ability to be recharged through the USB port 17. An adapter should be able to be connected to the USB port 17 in which this adapter should be also connected to an additional power supply. This power supply could be a wall outlet or any similar or existing technology that can receive and distribute electricity. It should be known that the USB port 17 can be used to electrically connect with a computer device or a separate electronic device. Although, the power source 16 could be replaced with another power source 14 after the power has been depleted without needing to be charged through the USB port 17. Or the entire encasement 1 could be disposable, and a new encasement 1 would be required. The preferred embodiment of the light switch 18 is an "ON/OFF" switch, which is shown in FIG. 4. This "ON/OFF" switch can be toggled to either allow power to flow or to restrict power to flow from the power source 16 to each of the illuminating sources 14. Therefore, by toggling the light switch 18 to the "ON" position, the illuminating sources 14 should begin to emit light. Another preferred embodiment of the light switch 18 is a variable switch that can permit power to be delivered in increments. This would provide the painter with the ability to control and vary the intensity of the light from the illuminating sources 14.

Figure 14:
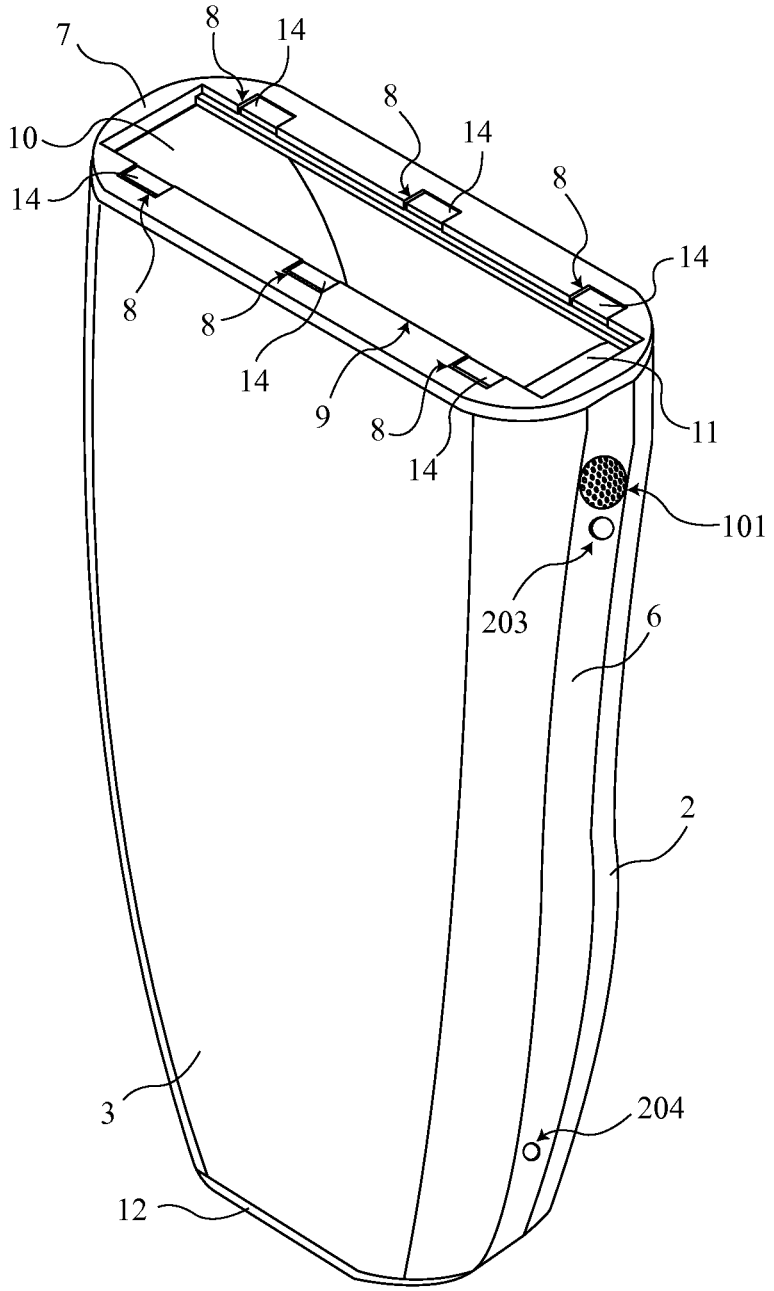
FIG. 14 is a perspective view of the present invention, showing an optional audible system and radiofrequency receiver.

The present invention can comprise a multitude of additional electrical components and should not only be limited to the aforementioned electrical components. An additional electrical component could be an audible system 101 that comprises a plurality of speaker wires 102 and a plurality of speakers 103, and also a radiofrequency transmitter that comprises a plurality of receiver wires 202. FIG. 14 shows the optional audible system 101. The speakers 103 of the audible system 101 should be electrically connected to the electronics processor 15 through the plurality of speaker wires 102 and should be integrated into the encasement 1 such that they are flush with the flat wall surface 3. The radiofrequency receiver 201 should also be electrically connected to the electronics processor 15 through the plurality of receiver wires 202. The radiofrequency receiver 201 should have the ability to scan the local area for FM or AM stations. A scanning button 203 should be provided for the user to trigger the scan. Upon selecting a desired station, the audible system 101 should be able to project the sound from the selected station through the plurality of speakers 103. In effect, these additional electronic components provide a painter with a portable stereo. Another optional embodiment of the present invention can implement blue tooth technology. This would allow the painter to communicate with others without having to carry around a cell phone. Also shown in FIG. 14 is a microphone 204, that a user would speak into; headphones could also be connected to the device for the user to listen to the sound or the sound could be projected through the audible system 101.

An alternative embodiment of the present invention implements a modified left elastic wall 10 and a right elastic wall 11. As opposed to a compressive pressure force being applied to the handle of a paintbrush strictly because the open path narrows from the wide top surface 7 to the narrow bottom surface 12, a mechanical tightening system could be implemented. The mechanical tightening system would function by decreasing the volume within the open passage by causing the left elastic wall 10 and the right elastic wall 11 both to contract inwards towards each other. By contracting, the open path should narrow, and a compressive force from the left elastic wall 10 and the right elastic wall 11 would lodge the paintbrush handle within the encasement 1.

The present invention is multifunctional and can be used in tandem with other painting accessories. It is not uncommon for a painter to strap a flashlight to a helmet, hardhat, head strap or similar head devices so that the lighting is steady and only moves with the motion of the painter's body, not their arm or hand. The present invention could be used to strap onto these head devices. Additional components or connections could simply be installed onto the present invention or adhesives such as Velcro could be simply adhered to the encasement 1 and to the head device to provide this capability without departing from the scope of the present invention.

Another alternative embodiment of the present invention could be an electronic grip sleeve that uses an interchangeable paintbrush head that does not need an entire paintbrush. The paintbrush head would be attached into the first receiving aperture 9 and the encasement 1 would operate as the handle of the paintbrush. Though, the paintbrush head could be fixed to the encasement 1 making the present invention an electronic paintbrush. This electronic paintbrush would not require any assembly with a paintbrush because the brush head would be part of the invention and the handle could simply be an elongated encasement 1.

Figure 16:
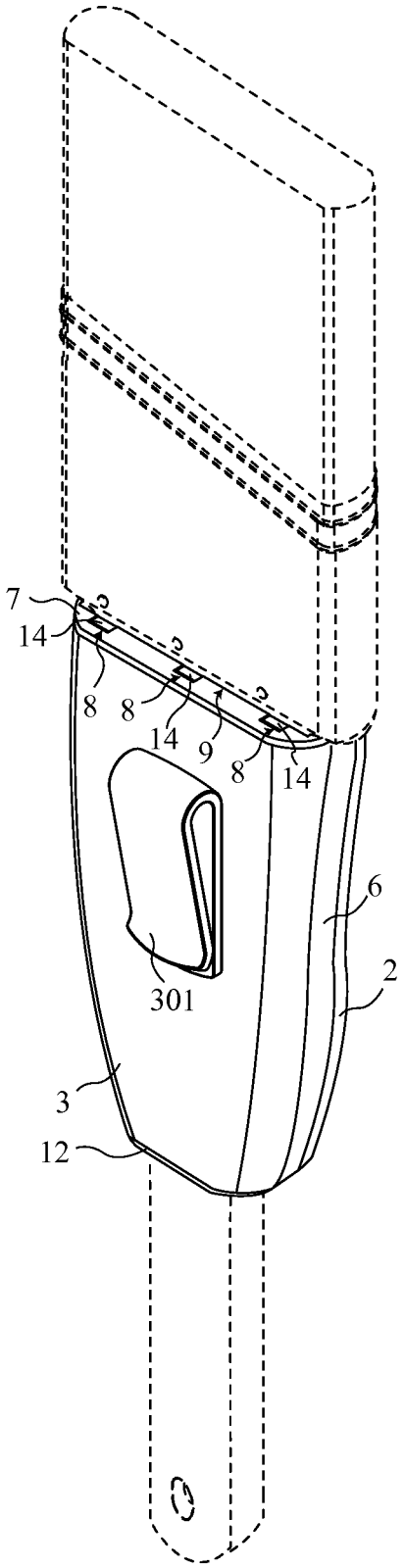
FIG. 16 is a perspective view of the present invention, showing a belt clip attachment.

Another alternative embodiment of the present invention comprises an attachment clip 301, which is shown in FIG. 16. This attachment clip 301 is essentially a clothing clip or belt clip for the encasement 1 to be attached to. The addition of this component allows a painter to easily transport the present invention. If the painter is needs to use multiple paintbrushes, whether for painting dissimilar colored surfaces as an example, the paint can then simply insert a paintbrush into the encasement 1 and then clip the encasement 1 with the paintbrush onto a belt or clothing apparel with the attachment clip 301. Therefore, the painter would have the capability to carry multiple paintbrushes at a time.

Although the invention has been explained in relation to its preferred embodiment, it is to be understood that many other possible modifications and variations can be made without departing from the spirit and scope of the invention as hereinafter claimed.

What is claimed is:

1. An electronic light emitting removable sleeve for a brush comprising:

an encasement having a first receiving aperture through a top wall and a second receiving aperture through a bottom wall, the encasement including an open path extending from the first receiving aperture to the second receiving aperture, the open path being configured to removably receive the brush;

at least one illuminating source positioned in or on a top wall exterior surface of the top wall;

at least one power source located within the encasement, the at least one power source being configured to power the at least one illuminating sources via an electrical circuitry;

at least one switch coupled to the at least one power source and the at least one illuminating source via the electrical circuitry, the at least one switch controlling power flow to the at least one illuminating source; and a rear wall having a wave-shaped exterior surface, a front wall having a flat exterior surface, a left wall having a rounded exterior surface, and a right wall having a rounded exterior surface located between the top wall exterior surface and a bottom surface.

2. The sleeve according to claim 1 further comprising;

at least one recessed groove recessed in the top wall exterior surface, each of the at least one recessed groove containing at least one of the at least one illuminating sources.

3. The sleeve according to claim 2 further comprising:

at least one groove cover located above or within a respective one of the at least one recessed grooves, the at least one groove cover enclosing one of the at least one illuminating source in the at least one recessed groove.

4. The sleeve according to claim 2 further comprising each of the at least one recessed groove being recessed in the top wall and positioned around the first receiving aperture.

5. The sleeve according to claim 1 further comprising:

at least one of the group consisting of an audible system, a speaker, a radio frequency receiver, a Bluetooth transceiver, a headphone jack, and a USB port coupled to the electrical circuitry.

6. The sleeve according to claim 1 further comprising:

an attachment clip.

7. The sleeve according to claim 1 further comprising the at least one switch being one of the group consisting of an on/off switch and a dimmer.

8. The sleeve according to claim 1 further comprising the electrical circuitry including a processor.

9. The sleeve according to claim 1 further comprising the at least one illuminating source being an LED.

10. The sleeve according to claim 1 further comprising:

an encasement wrap.

11. The sleeve according to claim 10 further comprising the encasement wrap being a rubber binding.

12. The sleeve according to claim 1 further comprising:

the front wall being positioned opposite the rear wall; and the rear wall being coupled to the front wall by the left wall and the right wall, the left wall positioned opposite the right wall.

13. The sleeve according to claim 1 further comprising:

a left elastic wall and a right elastic wall, the left elastic wall being located between the front and rear walls, the right elastic wall being located between the front and rear walls and opposite the left elastic wall.

14. The sleeve according to claim 13 further comprising the elastic wall curvature of the left elastic wall and the right elastic wall being substantially equivalent to the brush curvature of a portion of the brush with which the sleeve is utilized.

15. The sleeve according to claim 13 further comprising the left elastic wall and the right elastic wall being coupled to the front wall and the rear wall in a substantially perpendicular manner.

16. The sleeve according to claim 15 further comprising the left elastic wall and the right elastic wall being formed of a material able to exert a compressive stress on a portion of the brush when the portion is inserted into the open path.

17. The sleeve according to claim 1 further comprising the power source being at least one of the group consisting of a battery and a rechargeable power source.

18. The sleeve according to claim 1 further comprising:

a mechanical tightening system able to exert a compressive stress on a portion of the brush when portion is inserted into the open path.

19. A method for illuminating an area around a brush comprising:

slidably attaching a removable sleeve over a portion of the brush; and the removable sleeve being comprised of:

an encasement having a first receiving aperture through a top wall and a second receiving aperture through a bottom wall, the encasement including an open path extending from the first receiving aperture to the second receiving aperture, the open path being configured to removably receive a portion of the brush;

at least one illuminating source positioned in or on a top wall exterior surface of the top wall;

at least one power source located within the encasement, the at least one power source being configured to power the at least one illuminating sources via an electrical circuitry;

at least one switch coupled to the at least one power source and the at least one illuminating source via the electrical circuitry, the at least one switch controlling power flow to the at least one illuminating source; and a rear wall having a wave-shaped exterior surface, a front wall having a flat exterior surface, a left wall having a rounded exterior surface, and a right wall having a rounded exterior surface located between the top wall exterior surface and a bottom surface.

20. The method according to claim 19, wherein the at least one illuminating source directs light onto a surface.

21. The method according to claim 20, wherein the surface is a surface being painted.

* * * * *